US008377169B2

(12) United States Patent
Tokuda et al.

(10) Patent No.: US 8,377,169 B2
(45) Date of Patent: Feb. 19, 2013

(54) METHOD AND APPARATUS FOR MANUFACTURING GRANULAR METALLIC IRON

(75) Inventors: Koji Tokuda, Kobe (JP); Shuzo Ito, Kobe (JP); Shoichi Kikuchi, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 505 days.

(21) Appl. No.: 12/446,467

(22) PCT Filed: Oct. 18, 2007

(86) PCT No.: PCT/JP2007/070353

§ 371 (c)(1), (2), (4) Date: Apr. 21, 2009

(87) PCT Pub. No.: WO2008/059691

PCT Pub. Date: May 22, 2008

(65) Prior Publication Data

US 2010/0313710 A1 Dec. 16, 2010

(30) Foreign Application Priority Data

Nov. 14, 2006 (JP) ..... 2006-308209

(51) Int. Cl.
*C21B 13/10* (2006.01)

(52) U.S. Cl. ..... 75/484; 75/503

(58) Field of Classification Search ..... None
See application file for complete search history.

(56) References Cited

U.S. PATENT DOCUMENTS 4,622,905 A 11/1986 MacDougall et al.
5,400,358 A 3/1995 Vallomy
6,368,379 B1 4/2002 Tateishi et al.
6,383,251 B1 * 5/2002 Sherwood ..... 75/384
6,630,010 B2 * 10/2003 Ito et al. ..... 75/484
(Continued)

FOREIGN PATENT DOCUMENTS

CA 2 521 321 5/2010
EP 1 286 114 A2 2/2003
(Continued)

OTHER PUBLICATIONS

Extended European Search Report issued on Aug. 24, 2011 in the corresponding European Application No. 07830087.8.

(Continued)

*Primary Examiner* — George Wyszomierski
(74) *Attorney, Agent, or Firm* — Oblon, Spivak, McClelland, Maier & Neustadt, L.L.P.

(57) ABSTRACT

A method for manufacturing granular metallic iron by reducing a raw material mixture including an iron oxide-containing material and a carbonaceous reducing agent, comprises: a step of charging the raw material mixture onto a hearth of a moving hearth-type thermal reduction furnace; a step of reducing the iron oxide in the raw material mixture by the carbonaceous reducing agent through the application of heat, thereby forming metallic iron, subsequently melting the metallic iron, and coalescing the molten metallic iron to granular metallic iron while separating the molten metallic iron from subgenerated slag; and a step of cooling the metallic iron to solidify; wherein the heat-reducing step includes a step of controlling the flow velocity of atmospheric gas in a predetermined zone of the furnace within a predetermined range. This method makes it possible to manufacture the granular metallic iron of high quality.

3 Claims, 5 Drawing Sheets

U.S. PATENT DOCUMENTS

| | | | | |
|---|---|---|---|---|
| 8,012,236 | B2 * | 9/2011 | Tokuda et al. | 75/484 |
| 2001/0027701 | A1 | 10/2001 | Ito et al. | |
| 2001/0052273 | A1 | 12/2001 | Meissner et al. | |
| 2003/0037714 | A1 | 2/2003 | Tetsumoto et al. | |
| 2004/0163493 | A1 | 8/2004 | Harada et al. | |
| 2004/0211295 | A1 | 10/2004 | Kikuchi et al. | |
| 2009/0068488 | A1 | 3/2009 | Tokuda et al. | |

FOREIGN PATENT DOCUMENTS

| | | | |
|---|---|---|---|
| EP | 1 286 114 | A3 | 2/2003 |
| JP | 6-128657 | | 5/1994 |
| JP | 2001 279315 | | 10/2001 |
| JP | 2001-279315 | | 10/2001 |
| JP | 2003-073717 | | 3/2003 |
| JP | 2004-256868 | | 9/2004 |
| JP | 2004 285399 | | 10/2004 |
| JP | 2006 124838 | | 5/2006 |
| WO | WO 00/29628 | | 5/2000 |

OTHER PUBLICATIONS

Office Action issued Dec. 10, 2010, in Canadian Patent Application No. 2,663,831.

Office Action issued in Japanese Application No. 2006-308209 issued Dec. 6, 2011 with English translation.

* cited by examiner

METHOD AND APPARATUS FOR MANUFACTURING GRANULAR METALLIC IRON

TECHNICAL FIELD

The present invention relates to a method for manufacturing reduced iron by directly reducing an iron oxide source such as iron ore and iron oxide in a thermal reduction furnace, and an apparatus for manufacturing reduced iron by this method.

BACKGROUND ART

The direct reduced iron producing method has been known as a method for directly reducing an iron oxide source such as iron ore and iron oxide (which may be hereinafter referred to as iron oxide-containing material), by using a carbonaceous reducing agent (carbonaceous material) such as coal and a reducing gas so as to obtain reduced iron. The direct reduced iron producing method is based on such a procedure as charging a raw material mixture including the iron oxide-containing material and the carbonaceous reducing agent onto the hearth of a moving hearth-type thermal reduction furnace (for example, rotary hearth furnace), heating the raw material mixture with the heat from a burner and radiation heat while the raw material mixture is moved in the furnace so as to reduce the iron oxide included in the raw material mixture by the carbonaceous reducing agent, carburizing and melting the metallic iron (reduced iron) thus obtained, coalescing the molten metallic iron to granules while separating it from the subgenerated slag, and cooling and solidifying the molten metallic iron so as to obtain granular metallic iron (reduced iron).

The direct reduced iron producing method does not require a large scale facility such as blast furnace and has high flexibility with regards to resources for example, this method makes it unnecessary to use coke, therefore recently has been vigorously studied for commercial application. However, the direct reduced iron producing method has various problems to be solved in order to be applied on an industrial scale, including the stability of operation, safety, economy and quality of the granular metallic iron (product).

The granular metallic iron produced by the direct reduced iron producing method is sent to an existing steel making facility such as electric furnace or converter, and is used as the iron source. Therefore, with respect to the quality of the granular metallic iron, it is required to decrease the sulfur content in the granular metallic iron (may be hereinafter referred to as S content) to as low a level as possible. It is also desirable that the carbon content in the granular metallic iron (may be hereinafter referred to as C content) is high within a reasonable range, in order to broaden the applicability of the granular metallic iron as the iron source.

The inventors of the present application previously proposed a technology disclosed in Patent Document 1, which increases the purity of granular metallic iron so as to improve the quality of the granular metallic iron. Patent Document 1 discloses a method of increasing the purity of the granular metallic iron, which prevents the metallic iron from being oxidized again in a zone from the last stage of reduction to the completion of carburization and melting by controlling the reducing degree of the atmospheric gas in the vicinity of the compacts during carburizing and melting to a proper level.

Patent Document 1 also describes a technology to decrease the sulfur content in the granular metallic iron. Specifically, such a method of decreasing the sulfur content is disclosed that is based on controlling the basicity of the slag which is a byproduct generated when melting the metallic iron.

The inventors of the present application also previously proposed a technology described in Patent Document 2, besides that of Patent Document 1, which decreases the sulfur content in the granular metallic iron. Patent Document 2 discloses a method of decreasing the sulfur content in the granular metallic iron by controlling the basicity of the slag-forming component, that is determined from the composition of the raw material mixture, and controlling the MgO content in the slag-forming component.

Patent Document 1: Japanese Unexamined Patent Publication No. 2001-279315

Patent Document 2: Japanese Unexamined Patent Publication No. 2004-285399

DISCLOSURE OF THE INVENTION

The present invention has been devised with the background described above, and has an object of providing a method, different from the methods previously proposed, for manufacturing granular metallic iron of high quality (particularly with high C content and low S content) in a moving hearth-type thermal reduction furnace. Another object of the present invention is to provide an apparatus capable of manufacturing granular metallic iron of high quality.

In order to accomplish the above object, one aspect of the present invention is directed to a method for manufacturing granular metallic iron, whereby the granular metallic iron is manufactured by reducing a raw material mixture including an iron oxide-containing material and a carbonaceous reducing agent, the method comprises: a step of charging the raw material mixture onto a hearth of a moving hearth-type thermal reduction furnace; a step of reducing iron oxide in the raw material mixture by the carbonaceous reducing agent through the application of heat, thereby forming metallic iron, subsequently melting the metallic iron, and then coalescing the molten metallic iron to granular metallic iron while separating the molten metallic iron from subgenerated slag; and a step of cooling and solidifying the metallic iron; wherein the heat-reducing step includes a step of controlling a flow velocity of an atmospheric gas in a predetermined zone of the furnace within a predetermined range.

Another aspect of the present invention is directed to an apparatus for manufacturing granular metallic iron, whereby the granular metallic iron is manufactured by reducing a raw material mixture including an iron oxide-containing material and a carbonaceous reducing agent, the apparatus comprises: a thermal reduction furnace for reducing the iron oxide in the raw material mixture by the carbonaceous reducing agent through the application of heat, thereby forming metallic iron, subsequently melting the metallic iron, and then coalescing the molten metallic iron to granular metallic iron while separating the molten metallic iron from subgenerated slag; charging means that charges the raw material mixture into the thermal reduction furnace; discharging means that discharges the granular metallic iron and the slag from the thermal reduction furnace; and separating means that separates the metallic iron and the slag; wherein the thermal reduction furnace comprises: a furnace body; a moving hearth that transfers the raw material mixture and the metallic iron in the furnace body; heating means that heats the raw material mixture in the furnace body; and cooling means that cools and solidifies the molten metallic iron, while the furnace body has a predetermined zone which has control means to control a flow velocity of an atmospheric gas within a predetermined range.

BEST MODE FOR CARRYING OUT THE INVENTION

Hereinafter, the present invention will now be described in detail with reference to the accompanying drawings. It is understood that the drawings are not intended to limit the present invention, and there may be conceived various modifications to an extent that fits the foregoing and subsequent descriptions and are regarded as falling within the scope of the present invention.

Figure 1:
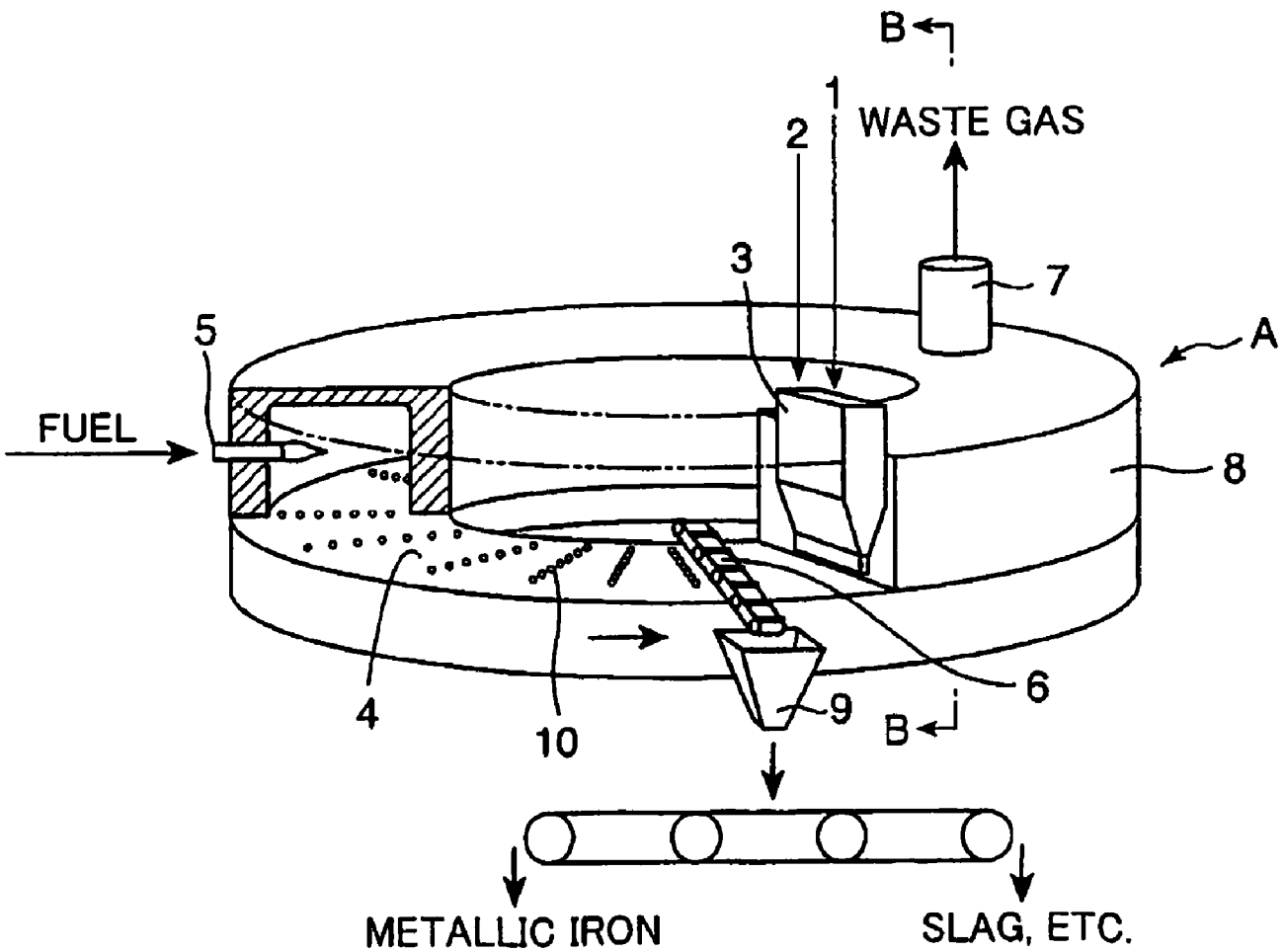
FIG. 1 is a schematic diagram explanatory of an example of the constitution of a rotary hearth-type thermal reduction furnace.

FIG. 1 is a schematic diagram explanatory of an example of the constitution of a rotary hearth-type thermal reduction furnace, among moving hearth-type thermal reduction furnaces. In a rotary hearth-type thermal reduction furnace A, a raw material mixture 1 including an iron oxide-containing material and a carbonaceous reducing agent is charged continuously through a material-charging hopper (charging means) 3 onto a rotary hearth 4 located in a furnace body 8. The raw material mixture 1 may include CaO, MgO, $SiO_2$ or other components which are included as the gangue or ash content, and may also include coal, dolomite, binder and the like as required. The raw material mixture 1 may be in the form of plain compacts or formed compacts such as pellets or briquettes. The raw material mixture 1 may be charged together with a carbonaceous material 2 in a powdery state.

A procedure of charging the raw material mixture 1 into the thermal reduction furnace A will now be described. Before charging the raw material mixture 1, the carbonaceous material 2 in a powdery state is charged from the material charging hopper 3 onto the rotary hearth 4 so as to form a bed of the carbonaceous material 2, upon which the raw material mixture 1 is charged.

While FIG. 1 shows the case where one material-charging hopper 3 is used to charge both the raw material mixture 1 and the carbonaceous material 2, two or more hoppers may be used to charge the raw material mixture 1 and the carbonaceous material 2 separately. The carbonaceous material 2 that is charged to form the bed is very useful not only for improving the efficiency of reducing, but also for accelerating the desulfurization of the granular metallic iron obtained by heat reduction.

The rotary hearth 4 of the rotary hearth-type thermal reduction furnace A shown in FIG. 1 is driven to rotate counter-clockwise. While the rotating speed depends on the size and operating conditions of the thermal reduction furnace A, the hearth typically makes one full turn in about 8 to 16 minutes. The furnace body 8 of the thermal reduction furnace A has a plurality of heating burners (heating means) 5 installed on the wall surface thereof, so as to supply heat to the hearth through the combustion heat of the heating burner 5 or radiation heat therefrom.

The raw material mixture 1 charged onto the rotary hearth 4 constituted from a refractory material is heated by the combustion heat of the heating burner 5 or radiation heat therefrom while moving on the rotary hearth 4 toward the periphery in the thermal reduction furnace A. Iron oxide included in the raw material mixture 1 is reduced while moving through a heating zone within the thermal reduction furnace A. Then, reduced iron is melted while being carburized by the remaining carbonaceous reducing agent. The molten reduced iron is then coalesced to granular metallic iron 10 while the molten slag which is formed as a byproduct is separated therefrom. The granular metallic iron 10 is cooled and solidified by the cooling means in a zone downstream of the thermal reduction furnace A, and is then discharged successively from the hearth by a discharging device (discharging means) 6 such as screw. At this time, while the slag is discharged at the same time, the metallic iron and the slag are separated by a separating means (such as a sieve or a magnetic classifier) after discharged from a hopper 9. In FIG. 1, reference numeral 7 denotes a waste gas duct.

When manufacturing the granular metallic iron in the moving hearth-type thermal reduction furnace, it is desired to carburize the granular metallic iron with a sufficient amount of carbon (may be hereinafter referred to as C) in order to broaden the applicability of the granular metallic iron as an iron source, and to minimize the sulfur (may be hereinafter referred to as S) content in order to improve the quality of the granular metallic iron as described above.

The inventors of the present application conducted research aimed at increasing the C content and minimizing the S content in the granular metallic iron. It was found that the composition of the granular metallic iron, which is obtained by heat-reducing the raw material mixture including the iron oxide-containing material and the carbonaceous reducing agent, is greatly affected by the flow velocity of the atmospheric gas in the thermal reduction furnace.

The inventors of the present application verified that the composition of the granular metallic iron is influenced by the flow velocity of the atmospheric gas in the thermal reduction furnace through such a mechanism as follows. The smaller the flow velocity of the atmospheric gas in the thermal reduction furnace, the smaller the flow velocity of the atmospheric gas becomes in the vicinity of the raw material mixture. Since the raw material mixture is surrounded by a reducing gas discharged from the bed material, a slower flow velocity accelerates the reduction and carburization reactions as a high reduction degree of the atmospheric gas is maintained, thus enabling a granular metallic iron having a high C content to be obtained. It was also verified that, when the reduction degree of the atmospheric gas is high in the vicinity of the raw material mixture, S in the raw material mixture can be easily fixed in the form of CaS in the slag by the CaO component of the raw material, thus accelerating the decrease in the S content in the granular metallic iron which is produced. A similar effect can be achieved also by decreasing the mean gas flow velocity of the atmospheric gas in the furnace, instead of decreasing the mean flow velocity of the atmospheric gas in the vicinity of the raw material mixture within the furnace. In the description that follows, the mean gas flow velocity of the atmospheric gas in the furnace will be taken as the flow velocity of the atmospheric gas in the thermal reduction furnace.

Figure 2:
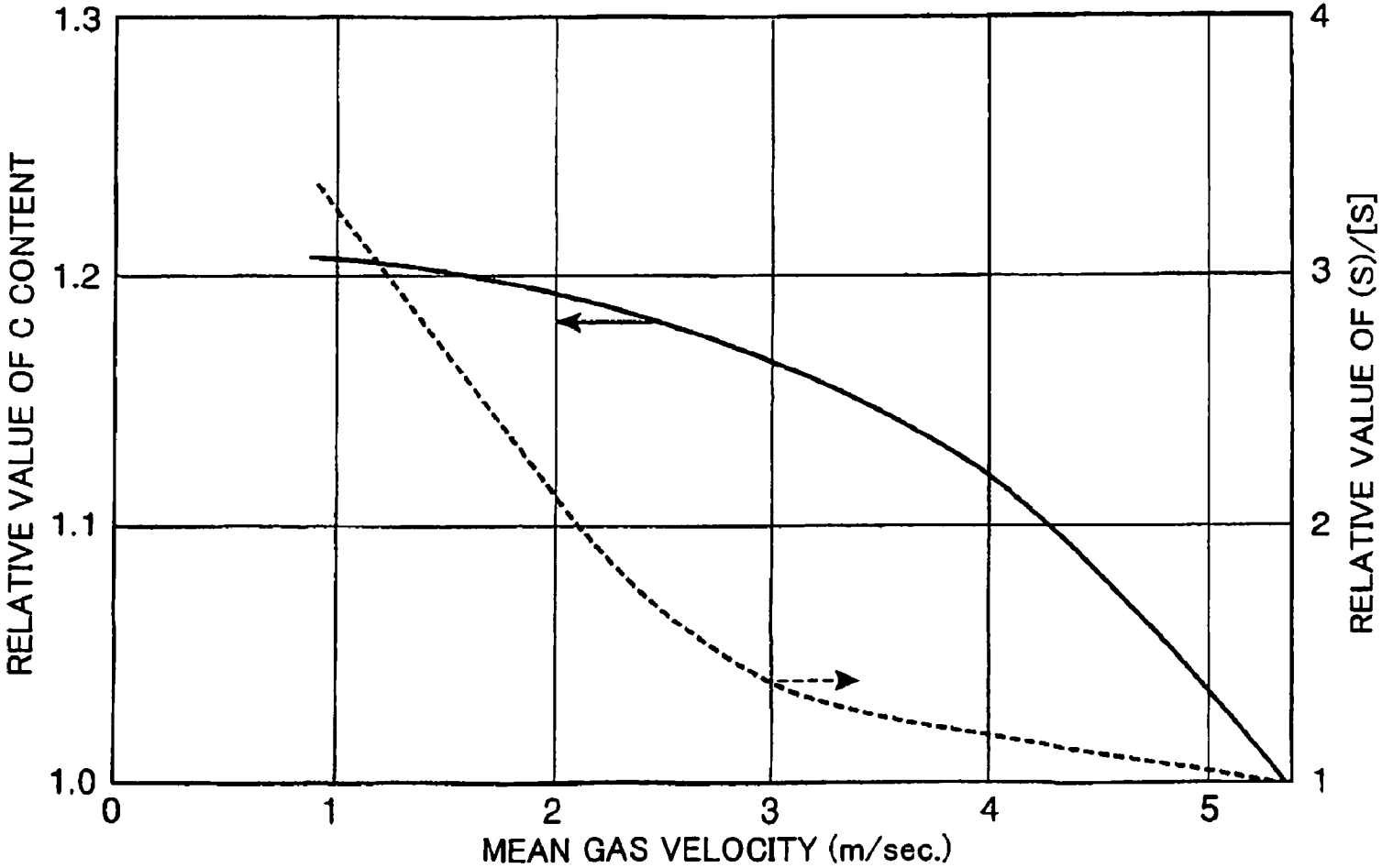
FIG. 2 is a graph showing the relationships between the mean gas flow velocity of the atmospheric gas in the thermal reduction furnace and the C content in the granular metallic iron, and between the mean gas flow velocity and the S content in the granular metallic iron.

FIG. 2 is a graph showing the relationships between the mean gas flow velocity of the atmospheric gas in the thermal reduction furnace and the C content in the granular metallic iron, and between the mean gas flow velocity and the S content in the granular metallic iron. In FIG. 2, the proportion of sulfur content "(S)/[S]" is used as an index of the sulfur content in the granular metallic iron, where (S) represents the concentration of sulfur in the molten slag and [S] represents the concentration of sulfur in the molten iron (reduced iron). The value of C content shown in FIG. 2 is given as a relative value normalized to the C content in the granular metallic iron (which is set to 1) obtained in the apparatus shown in FIG. 3, which will be described later, where all the heating burners installed in the furnace are air burners. Similarly, the proportion of sulfur content shown in FIG. 2 is given as a relative value normalized to the sulfur content in the granular metallic iron (which is set to 1) obtained in the apparatus shown in FIG. 3, which will be described later, where all the heating burners installed in the furnace are air burners. The mean gas flow velocity is given by calculating the mean gas flow velocity at a position between an air burner 5*e* and an oxygen burner 5*f* of the apparatus shown in FIG. 3, which will be described later. The method of measuring the mean gas flow velocity will be described later.

As will be clearly seen from FIG. 2, there is a correlation between the mean gas flow velocity of the atmospheric gas and the C content in the granular metallic iron. A correlation exists also between the mean gas flow velocity of the atmospheric gas and the S content in the granular metallic iron. Specifically, the concentration of sulfur in the molten slag (S) can be increased relative to the concentration of sulfur in the molten iron (reduced iron) [S], by controlling the mean gas flow velocity to 5 meters per second or less (particularly 2.5 meters per second or less) and, as a result, the concentration of sulfur in the molten iron (reduced iron) [S] can be decreased.

The flow velocity of the atmospheric gas is preferably controlled at least in a zone ranging from the last stage of reducing the iron oxide (may be referred to simply as the last stage of reduction in this specification) to the completion of melting of the metallic iron (may be referred to simply as the completion of melting in this specification) in the furnace body. This is because, in the area from the last stage of reduction to the melting zone, the vicinity of the raw material mixture is kept as a reducing atmosphere by the gas discharged from the carbonaceous reducing agent and the bed material, and this atmospheric gas has great influence on the composition of the granular metallic iron. Therefore, the C content in the granular metallic iron can be increased and S content can be decreased by controlling the gas velocity in this zone. The flow velocity of the atmospheric gas may be controlled throughout the furnace body, not only in the zone from the last stage of reduction of the iron oxide to the completion of melting of the metallic iron. While the position in the furnace body corresponding to the last stage of reduction varies depending on the scale and operation conditions of the thermal reduction furnace, as a rough guideline, it may be a position about two thirds from the upstream in the heating zone. The heating zone refers to an area within the furnace body where the heating burners are installed.

The flow velocity of atmospheric gas in the predetermined zone of the furnace body can be controlled by providing means for controlling the flow velocity of the atmospheric gas in the moving hearth-type thermal reduction furnace. For example, the flow velocity control means may be oxygen burners provided as part of the heating burners that heat the inside of the thermal reduction furnace, or such a construction as the height from the hearth to the ceiling (may be referred to simply as the height of the ceiling in this specification) at least in the zone from the last stage of reduction to the completion of melting within the furnace body is larger than the height from the hearth to the ceiling in the other zones of the furnace body. This will be described below by making reference to the drawings.

Figure 3:
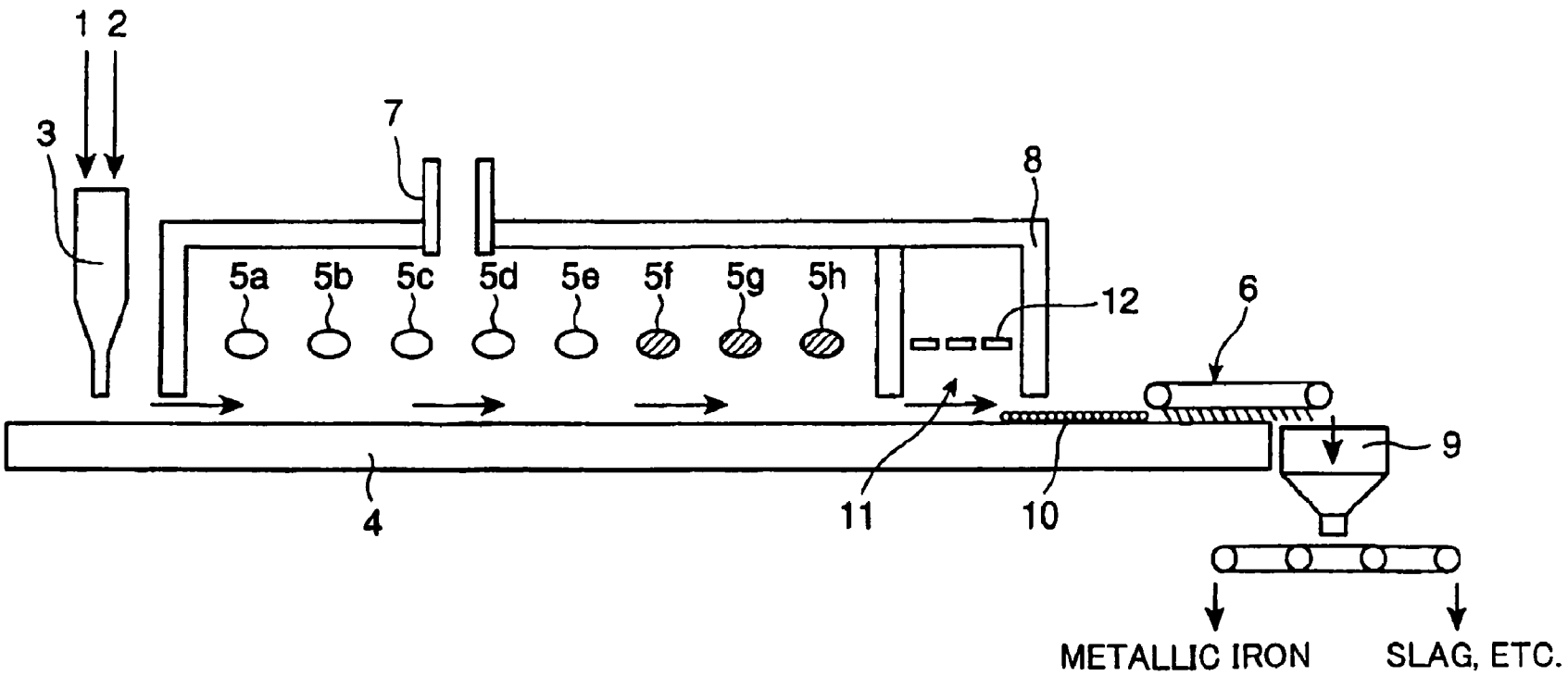
FIG. 3 is a schematic sectional view of the rotary hearth-type thermal reduction furnace shown in FIG. 1 developed along a hypothetical cylindrical surface which includes line B-B.

First, a rotary hearth-type thermal reduction furnace having oxygen burners used as part of the heating burners that heat the inside of the thermal reduction furnace as the flow velocity control means will be described. FIG. 3 is a schematic sectional view of the rotary hearth-type thermal reduction furnace shown in FIG. 1 developed along a hypothetical cylindrical surface which includes line B-B, showing an area from the material-charging section to the metallic iron-discharging section in the rotary hearth-type thermal reduction furnace. Portions identical to those shown in FIG. 1 are identified with identical reference numerals.

FIG. 3 shows the zone from the last stage of reduction to the completion of melting as an area where the heating burners 5*a* through 5*h* are installed, and the heating burners 5*f* through 5*h* are installed on the wall surface of the furnace body 8. Among the heating burners, the heating burners 5*a* through 5*e* are air burners and the heating burners 5*f* through 5*h* are oxygen burners. Air burner refers to a burner that burns a combustible gas (for example, methane gas) by mixing air therewith, and oxygen burner refers to a burner that burns a combustible gas by mixing oxygen therewith. In the air burner, larger quantities of gases that do not contribute to the combustion (i.e. uninvolved gases with combustion, such as nitrogen, argon) are supplied per unit time than in the case of the oxygen burner when the both burners burn the same amount of a combustible gas. As shown in FIG. 3, the furnace body 8 has a cooling zone 11 provided therein for cooling the molten iron obtained by heat reduction, and the cooling zone 11 has a cooling means 12 installed therein.

The raw material mixture 1 charged through the material charging hopper 3 in the upstream at a position located on the left-hand side in FIG. 3 is heated and reduced while moving to the right-hand side (downstream) in FIG. 3. The flow velocity of the atmospheric gas in the furnace can be decreased by using the oxygen burners 5*f* through 5*h* as at least part of the burners that heat the inside of the thermal reduction furnace. In the case where air burners are used for all of the heating burners 5*a* through 5*h*, since oxygen accounts for about 20% by volume of air, a gas flow rate of about 80% by volume of the air which does not contribute to the combustion has an influence on the attempt to increase the flow velocity in the thermal reduction furnace. The use of the oxygen burners as at least part of the heating burners, however, makes it possible to decrease the total gas quantity supplied to the thermal reduction furnace and, as a result, to decrease the flow velocity of atmospheric gas in the furnace while maintaining the level of combustion heat generated by using the air burners.

The mean gas flow velocity of atmospheric gas in the furnace V (m/sec.) is calculated by dividing the total gas flow rate Q ($m^3$/sec.) by the cross sectional area D ($m^2$) of the inner space of the furnace perpendicular to the moving direction in the furnace as indicated by the equation (1). The total gas flow rate Q ($m^3$/sec.) is the quantity of gas flowing per unit time after combustion, determined from the quantity of fuel supplied into the furnace per unit time (second) and the quantity of oxygen-containing gas supplied per unit time (second) for burning the fuel.

$$V=Q/D \quad (1)$$

When methane gas, for example, is supplied as the fuel and is burned in the furnace, the chemical reaction represented by (2) occurs. The quantity of gas generated by combustion can be calculated from the quantity of fuel supplied into the furnace and the quantity of oxygen-containing gas supplied for burning the fuel. The quantity of gas is preferably calculated by converting the quantity into volume at the actual temperature and pressure in the furnace.

$$CH_4+2O_2 \rightarrow CO_2+2H_2O \quad (2)$$

The gas generated by combustion in the furnace flows from the upstream of the hearth toward the waste gas duct 7, or from the downstream of the hearth toward the waste gas duct 7, in the case where the waste gas duct 7 is provided above the space between the air burners 5*c* and 5*d* as shown in FIG. 3. Thus, the mean gas flow velocity of the atmospheric gas in the zone from the last stage of reduction to the completion of melting may be calculated by dividing the gas flow rate passing the start position of the last stage of reduction (position between the air burner 5*e* and the oxygen burner 5*f* in FIG. 3) by the longitudinal sectional area of the furnace (area of the flow path) at the start position of the last stage of reduction (position between the air burner 5*e* and the oxygen burner 5*f* in FIG. 3). In this case, the gas passing the start position of the last stage of reduction flows from the right toward the left in FIG. 3. Therefore, the gas flow rate through the start position of the last stage of reduction may be determined by calculating the total quantity of gas after combustion from the quantity of fuel supplied to the oxygen burners 5*f* through 5*h* and the quantity of oxygen-including gas supplied for burning the fuel. This is because, since the waste gas duct 7 is provided above the space between the air burners 5*c* and 5*d*, the flow velocity of the gas generated by burning the fuel in the air burners 5*a* through 5*e* has no influence on the mean gas flow velocity of the atmospheric gas in the zone from the last stage of reduction to the completion of melting.

The mean gas flow velocity can be controlled by adjusting the number of air burners and oxygen burners, the arrangement of the air burners and the oxygen burners, or the quantities of the fuel and the oxygen-containing gas for burning the fuel supplied to the air burners and to the oxygen burners. Instead of the air burners and the oxygen burners, a burner to which a relatively large quantity of gas that does not contribute to combustion (uninvolved gas with combustion) is supplied per unit time (second burner) and a burner to which a relatively small quantity of gas that does not contribute to combustion is supplied per unit time (first burner), where the "relatively large" and the "relatively small" mean a relative comparison based on the same amount of fuel in combustion, may be used.

According to the present invention, there is no limitation on the position where the waste gas duct 7 is installed. In order to make the flow velocity of the atmospheric gas as low as possible in the zone from the last stage of reduction to the completion of melting, however, it is preferable to install the waste gas duct 7 at a position upstream (nearer to the position where the raw material mixture is supplied) than the zone from the last stage of reduction to the completion of melting.

While there is no restriction on the zone of the thermal reduction furnace where the oxygen burners are installed, the burner may be installed at least in the zone from the last stage of reduction to the completion of melting. The oxygen burners may also be used in the entire zone within the thermal reduction furnace.

While there is no restriction on the position where an oxygen burner (first burner) is installed, the burner is preferably installed at a position at least 1 meter above the surface of the hearth. This is because, even when the oxygen burners are used instead of the air burners, the gas velocity becomes high if the oxygen burners are installed near the hearth.

In order to decrease the flow velocity of the atmospheric gas in the vicinity of the raw material mixture, it is preferable to install the oxygen burners (first burners) as far away from the hearth surface as possible. However, when the oxygen burners are installed away from the hearth too much, efficiency of heating becomes lower. Installing the oxygen burners near the ceiling may result in damaging of the ceiling caused by the heat from the burner. Thus, the oxygen burners (first burner) are preferably installed at positions at least 1 meter away from the ceiling surface.

Oxygen concentration in the oxygen-containing gas supplied to the oxygen burners (first burners) is preferably as high as possible so as to decrease the flow velocity of the atmospheric gas. This is because a higher oxygen concentration leads to a lower concentration of gases that do not contribute to combustion. The proportion of oxygen gas in the gas supplied may be, for example, 90% by volume or higher.

The constitution of the rotary hearth-type thermal reduction furnace employed as the flow velocity control means will now be described, where the height from the hearth to the ceiling is at least in the zone from the last stage of reduction to the completion of melting of the metallic iron in the entire furnace is larger than the height from the hearth to the ceiling in the other zones of the furnace body.

Figure 4:
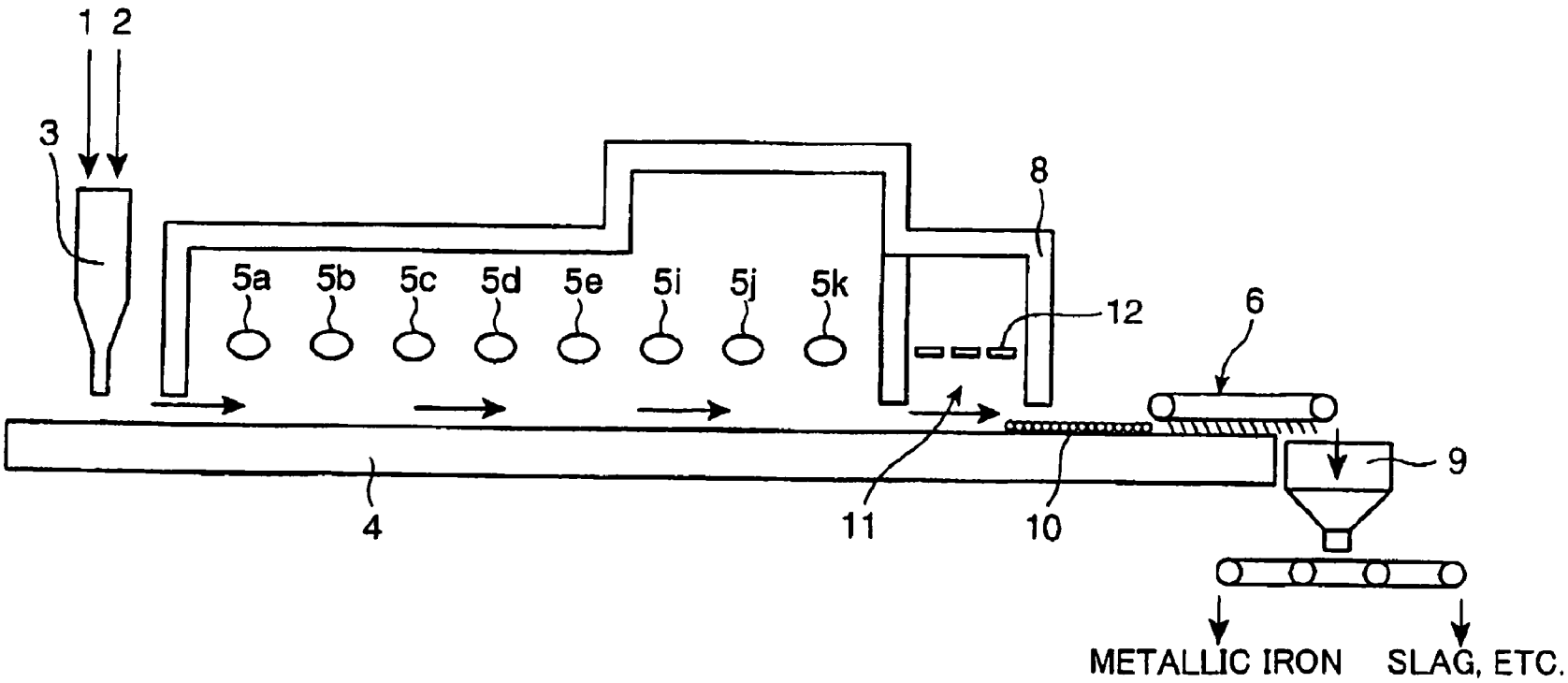
FIG. 4 is a schematic sectional view showing a partially modified example of the constitution shown in FIG. 3.

FIG. 4 is a schematic sectional view showing an example of partially modifying the constitution shown in FIG. 3, where the furnace body 8 has the heating burners 5*a* through 5*e* and the heating burners 5*i* through 5*k* installed on the wall surface thereof, while the area where the heating burners 5*i* through 5*k* are installed corresponds to the zone from the last stage of reduction to the completion of melting. In FIG. 4, all of the heating burners are air burners.

FIG. 4 shows the furnace body 8 having such a configuration as the height of the ceiling in the zone where the heating burners 5*i* through 5*k* are installed is larger than the ceiling height in the other zones. Making the ceiling higher in this way enables the volume of the inner space of the furnace corresponding to the zone from the last stage of reduction to the completion of melting to be increased. This in turn enables the flow velocity of the atmospheric gas in the furnace to be lower than in the case where the ceiling in this zone is lower.

Figure 5:
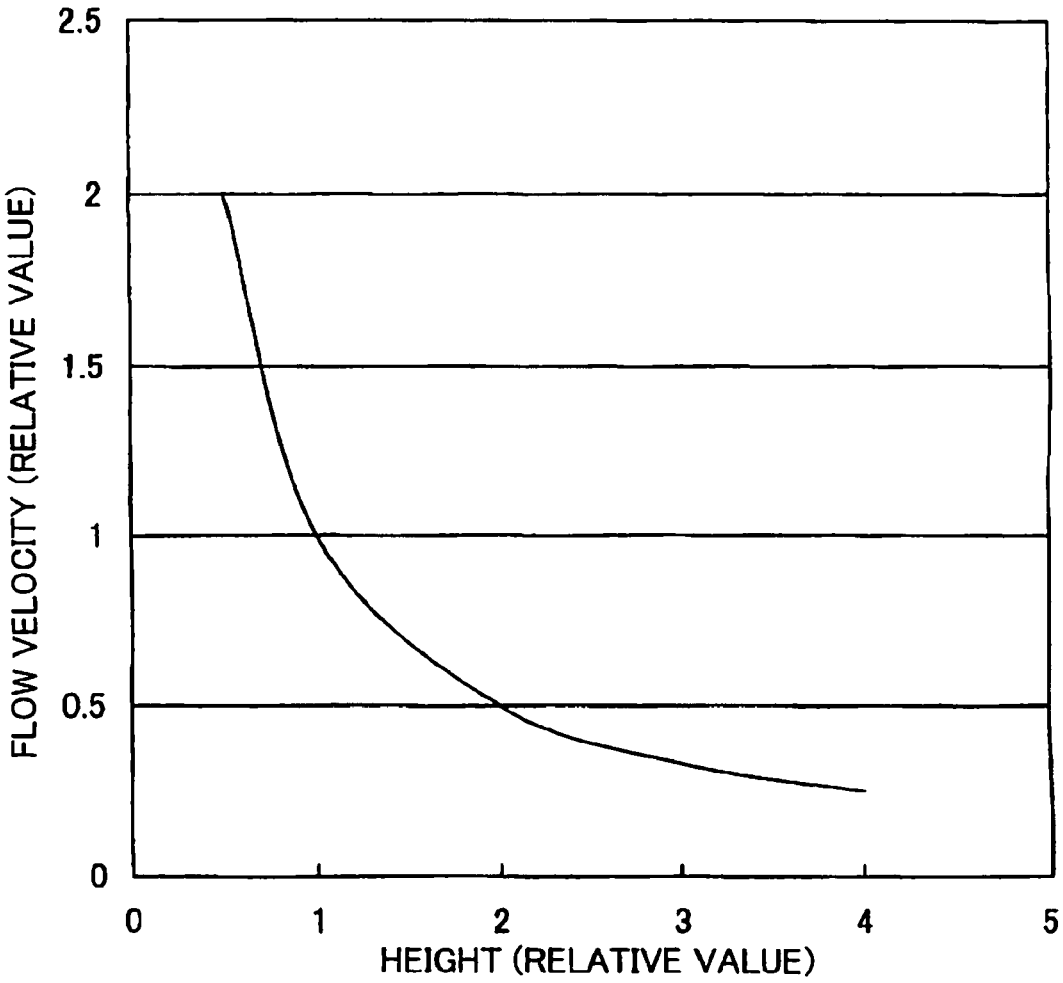
FIG. 5 is a graph showing the relationship between the height from the hearth to the ceiling and the flow velocity of the atmospheric gas in the furnace.

FIG. 5 is a graph showing the relationship between the relative value of the ceiling and the relative value of the mean flow velocity of the atmospheric gas in the furnace.

The relative value of height of the ceiling was given in terms of the height of the ceiling in the zone from the last stage of reduction to the completion of melting relative to the height of the ceiling in the zones up to the last stage of reduction (other zones), by taking as a reference the case where the ceiling height is not changed between the input area where the raw material mixture is charged and the output area where the granular metallic iron is discharged to the outside (namely, the case of setting the ceiling height constant as shown in FIG. 3).

The relative value of the mean gas flow velocity of the atmospheric gas was given in terms of a value calculated from mean gas flow velocity with changed ceiling height in the zone from the last stage of reduction to the completion of melting, by taking as a reference the case where the ceiling height is not changed between the input area where the raw material mixture is charged and the output area where the granular metallic iron is discharged to the outside (namely, the case of setting the ceiling height constant as shown in FIG.

3). The mean gas flow velocity was calculated for a position where the height of the ceiling above the hearth is changed (for example, between the heating burners 5*e* and 5*i* in the case shown in FIG. 4).

As will be clearly seen from FIG. 5, the flow velocity of the atmospheric gas in the furnace decreases when the ceiling height is increased.

While the case where only the air burners are used as the heating burners is shown in FIG. 4, one or plurality of oxygen burners (first burners) may also be provided for a part of the heating burners as the flow velocity control means.

In the example of the constitution shown in FIG. 3 and FIG. 4, a partition wall may be installed in the furnace, in order to minimize the influence exerted by the flow velocity of the atmospheric gas in the other zones of the furnace on the flow velocity of the atmospheric gas in the zone from the last stage of reduction to the completion of melting in the furnace. For example, in the case where the zone from the last stage of reduction to the completion of melting is the zone where the oxygen burners 5*f* through 5*h* are installed as shown in FIG. 3, a suspended partition wall may be installed on the ceiling between the air burner 5*e* and the oxygen burner 5*f*. In this case, an exhaust means may be installed on the ceiling in each zone so as to discharge the waste gas from each zone to the outside.

While the case of using the rotary hearth-type thermal reduction furnace as the moving hearth-type thermal reduction furnace has been described, the present invention is not limited to the rotary hearth-type thermal reduction furnace, and any moving hearth-type such as straight type thermal reduction furnace may also be employed.

As described above, the method for manufacturing the granular metallic iron according to one aspect of the present invention, whereby the granular metallic iron is manufactured by reducing the raw material mixture including the iron oxide-containing material and the carbonaceous reducing agent, comprises: a step of charging the raw material mixture onto a hearth of a moving hearth-type thermal reduction furnace; a step of reducing the iron oxide in the raw material mixture by the carbonaceous reducing agent through the application of heat, thereby forming metallic iron, subsequently melting the metallic iron, and then coalescing the molten metallic iron to granular metallic iron while separating the molten metallic iron from subgenerated slag; and a step of cooling and solidifying the metallic iron; wherein the heat-reducing step includes a step of controlling a flow velocity of an atmospheric gas in a predetermined zone of the furnace within a predetermined range.

According to the method of manufacturing the granular metallic iron of the present invention, the quality of the granular metallic iron can be improved by controlling the flow velocity of the atmospheric gas in a predetermined zone of the furnace within a predetermined range when manufacturing the granular metallic iron in the moving hearth-type thermal reduction furnace. More specifically, the C content in the granular metallic iron can be increased and the S content can be decreased.

According to the method of manufacturing the granular metallic iron of the present invention, the flow velocity of the atmospheric gas is preferably in a range from 0 meters per second to 5 meters per second on average. When the velocity is within this range, the reduction degree of the atmospheric gas is maintained at a high level so that reduction and carburization proceed efficiently, and therefore the C content in the granular metallic iron can be increased and the S content can be decreased.

Also, according to the method of manufacturing the granular metallic iron of the present invention, it is preferable that the predetermined zone is a zone from a last stage of reducing the iron oxide to the completion of melting of the metallic iron. This makes it possible to improve the quality of the granular metallic iron by keeping the reducing atmosphere in this zone.

Also, according to the method of manufacturing the granular metallic iron of the present invention, it is preferable that burners are used in heating of the thermal reduction furnace, and a first burner is used in the predetermined zone, while in a zone or zones other than the predetermined zone a second burner to which a larger quantity of gas which do not contribute to the combustion is supplied per unit time than to the first burner, in the case that the same quantity of fuel is burned in the both burners, is used. In this case, it is preferable to use the oxygen burners in the predetermined zone and use at least air burners in a zone or zones other than the predetermined zone. This makes it possible to make the total quantity of gas supplied into the thermal reduction furnace smaller compared to a case of using air burners as some or all of the heating burners in the predetermined zone, while maintaining the same level of heat generation. As a result, the flow velocity of the atmospheric gas in the predetermined zone can be decreased.

The apparatus for manufacturing the granular metallic iron according to another aspect of the present invention, whereby the granular metallic iron is manufactured by reducing a raw material mixture including an iron oxide-containing material and a carbonaceous reducing agent, comprises: a thermal reduction furnace for reducing iron oxide in the raw material mixture by the carbonaceous reducing agent through the application of heat, thereby forming metallic iron, subsequently melting the metallic iron, and then coalescing the molten metallic iron to granular metallic iron while separating the molten metallic iron from subgenerated slag; charging means that charges the raw material mixture into the thermal reduction furnace; discharging means that discharges the granular metallic iron and the slag from the thermal reduction furnace; and separating means that separates the metallic iron and the slag; wherein the thermal reduction furnace comprises: a furnace body, a moving hearth that transfers the raw material mixture and the metallic iron in the furnace body, heating means that heats the raw material mixture in the furnace body, and cooling means that cools and solidifies the molten metallic iron, while the furnace body has a predetermined zone which has control means to control a flow velocity of an atmospheric gas within a predetermined range.

According to the apparatus of manufacturing the granular metallic iron of the present invention described above, since the flow velocity of the atmospheric gas in the predetermined zone is lower than that of the apparatus without flow velocity control means, higher reduction degree of the atmosphere in the predetermined zone can be maintained so as to obtain a granular metallic iron of high quality. More specifically, granular metallic iron having higher C content and lower S content can be obtained.

According to the apparatus for manufacturing the granular metallic iron of the present invention, the flow velocity of the atmospheric gas in the predetermined zone is preferably in a range from 0 meters per second to 5 meters per second on average, and more preferably in a range from 0 meters per second to 2.5 meters per second on average. This makes it possible to maintain the reduction degree of the atmospheric gas at a high level in the predetermined zone so that reduction and carburization proceed efficiently, and therefore C content in the granular metallic iron can be increased and S content can be decreased.

Also, according to the apparatus for manufacturing the granular metallic iron of the present invention, it is preferable that the predetermined zone is a zone from a last stage of reducing the iron oxide to completion of melting the metallic iron. This which makes it possible to obtain a granular metallic iron having a higher quality, as reduction degree of the atmosphere in the predetermined zone is kept at a higher level than that of the other zones.

Also, according to the apparatus for manufacturing the granular metallic iron of the present invention, it is preferable that the heating means comprises: a first burner; and a second burner to which larger quantities of gases which do not contribute to the combustion are supplied per unit time than to the first burner in the case that the same quantity of fuel is burned in the both burners, while the first burner is installed in the predetermined zone and the second burner is installed in another zone or zones. In this case, it is preferable that the first burner is an oxygen burner and the second burner is an air burner. This makes it possible to decrease the total quantity of gas supplied into the thermal reduction furnace while maintaining the same level of heat generation, compared to a case of using air burners as some or all of the heating burners in the predetermined zone. As a result, the flow velocity of the atmospheric gas in the predetermined zone can be decreased so as to obtain a granular metallic iron having higher C content and lower S content.

Also, according to the apparatus for manufacturing the granular metallic iron of the present invention, it is preferable that the first burner is installed at a position at least 1 meter away from the surface of the hearth. This enables it to prevent the flow velocity of atmospheric gas in the vicinity of the hearth from becoming higher than in the case of installing the first burner near the hearth. As a result, a granular metallic iron having higher quality can be obtained.

Also, according to the apparatus for manufacturing the granular metallic iron of the present invention, it is preferable that the furnace body has such a shape that an area of a flow path of the atmospheric gas in the predetermined zone (of the furnace body) is larger than an area of a flow path of the atmospheric gas of the other zones. It is also preferable that, in the apparatus for manufacturing the granular metallic iron of the present invention, the furnace body has such a shape that the height from the hearth to the ceiling in the predetermined zone (of the furnace body) is larger than the height of the ceiling from the hearth in the other zones. This makes it possible to make the flow velocity of the atmospheric gas in the predetermined zone lower than in the case of forming the furnace body with such a configuration as the predetermined zone having the same area of the flow path of the atmospheric gas as the area of the flow path of the atmospheric gas of the other zones. As a result, a granular metallic iron having higher quality is obtained.

Also, according to the apparatus for manufacturing the granular metallic iron of the present invention, it is preferable that the furnace body further has a partition wall that divides the predetermined zone from the other zones. This enables controlling the flow velocity of the atmospheric gas in the predetermined zone and the flow velocity of the atmospheric gas in the other zones independently, so that a granular metallic iron having higher quality can be obtained.

The invention claimed is:

1. A method for manufacturing granular metallic iron by reducing a raw material mixture including an iron oxide-containing material and a carbonaceous reducing agent, comprising:

charging the raw material mixture onto a hearth of a moving hearth-type thermal reduction furnace;

reducing the iron oxide in the raw material mixture by the carbonaceous reducing agent through the application of heat, thereby forming metallic iron, subsequently melting the metallic iron, and then coalescing the molten metallic iron to granular metallic iron while separating the molten metallic iron from subgenerated slag; and cooling and solidifying the metallic iron; wherein the application of heat comprises controlling a flow velocity of an atmospheric gas in a predetermined zone of the furnace wherein the predetermined zone is a zone from a last stage of reducing the iron oxide to completion of melting the metallic iron, and wherein burners are used in the heating of the thermal reduction furnace, said burners comprising a first burner in the predetermined zone, and a second burner in a zone or zones other than the predetermined zone to which a larger quantity of gas which does not contribute to the combustion is supplied per unit time than to the first burner when the same quantity of fuel is burned in both burners.

2. The manufacturing method according to claim 1, wherein the flow velocity of the atmospheric gas is in a range from 0 meters per second to 5 meters per second on average.

3. The manufacturing method according to claim 1, wherein oxygen burners are used in the predetermined zone, and at least air burners are used in the zone or zones other than the predetermined zone.

* * * * *